US011043315B2

(12) United States Patent
Altingöz et al.

(10) Patent No.: US 11,043,315 B2
(45) Date of Patent: Jun. 22, 2021

(54) FIRE RESISTANT SIGNALLING CABLE FOR RAILWAY APPLICATIONS

(71) Applicant: Prysmian S.p.A, Milan (IT)

(72) Inventors: Can Altingöz, Milan (IT); Baris Sönmez, Milan (IT); Nedim Yildiz, Milan (IT); Zekeriya Sirin, Milan (IT)

(73) Assignee: Prysmian S.p.A., Milan (IT)

( * ) Notice: Subject to any disclaimer, the term of this patent is extended or adjusted under 35 U.S.C. 154(b) by 0 days.

(21) Appl. No.: 16/678,358

(22) Filed: Nov. 8, 2019

(65) Prior Publication Data

US 2020/0152357 A1 May 14, 2020

(30) Foreign Application Priority Data

Nov. 8, 2018 (IT) ..... 102018000010156

(51) Int. Cl.
*H01B 7/18* (2006.01)
*H01B 7/295* (2006.01)

(52) U.S. Cl.
CPC ..... *H01B 7/295* (2013.01); *H01B 7/183* (2013.01); *H01B 7/1875* (2013.01)

(58) Field of Classification Search
USPC ..... 174/121 A, 107
See application file for complete search history.

(56) References Cited

U.S. PATENT DOCUMENTS 4,963,695 A * 10/1990 Marciano-Agostinelli ..... H01B 7/288 174/23 C
6,259,031 B1 * 7/2001 Totland ..... H01B 11/02 174/110 R
2003/0159848 A1 * 8/2003 Hopkinson ..... H01B 11/04 174/113 C
2004/0184748 A1 * 9/2004 Clatanoff ..... G02B 6/4436 385/113
2004/0238979 A1 * 12/2004 Yamano ..... B29C 48/156 264/1.28
2005/0219063 A1 * 10/2005 Viswanathan ..... G01V 1/52 340/854.9
2008/0246576 A1 * 10/2008 Terlizzi ..... H01F 17/06 336/175
2014/0008098 A1 * 1/2014 Scaglione ..... H01B 7/28 174/107

(Continued)

FOREIGN PATENT DOCUMENTS

CN 202394553 U * 8/2012
CN 206849542 U * 1/2018
WO WO-2017097350 A1 * 6/2017 ..... H01B 7/295

OTHER PUBLICATIONS

Fiberglass—Wikipedia _ pp. 1-11_Mar. 2018.*

*Primary Examiner* — Timothy J Thompson
*Assistant Examiner* — Guillermo J Egoavil
(74) *Attorney, Agent, or Firm* — Seed IP Law Group LLP

(57) ABSTRACT

The present disclosure relates to a signalling cable that includes: a cable core, a metallic screen surrounding and in direct contact with the cable core, and at least one flame retardant low smoke zero halogen polymeric sheath surrounding and in radially position with respect to the metallic screen. The cable core includes a plurality of insulated electric conductors and a core wrap. The insulated electric conductors each includes an electric conductor insulated by a fire barrier and a flame retardant low smoke zero halogen polymeric insulating layer.

16 Claims, 1 Drawing Sheet

(56) References Cited

U.S. PATENT DOCUMENTS

| | | | | |
|---|---|---|---|---|
| 2014/0014393 | A1* | 1/2014 | Wollitzer | H01B 11/04 174/108 |
| 2017/0307839 | A1* | 10/2017 | Bradley | G02B 6/4486 |
| 2018/0096753 | A1* | 4/2018 | Dettmer | H01B 3/082 |
| 2019/0080823 | A1* | 3/2019 | Armbrecht | H01B 11/08 |
| 2019/0304624 | A1* | 10/2019 | Szylakowski | H01B 11/02 |
| 2020/0126690 | A1* | 4/2020 | Sirin | H01B 7/295 |

* cited by examiner

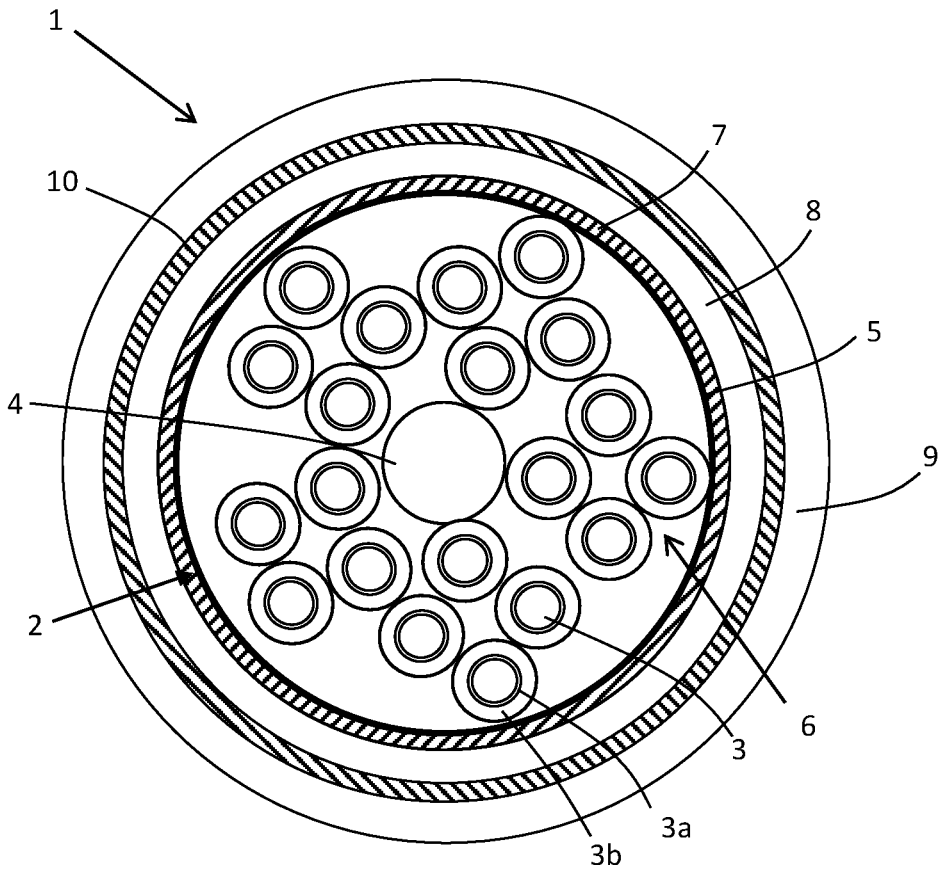
1
10
7
8
5
4
9
2
6
3
3a
3b

FIRE RESISTANT SIGNALLING CABLE FOR RAILWAY APPLICATIONS

BACKGROUND

Technical Field

The present disclosure relates to a signalling cable, particularly to a fire resistant signalling cable for railway systems.

Description of the Related Art

Signalling cables are used in railway networks for various applications, including, for example, light switching in signalling equipment, track changing and communications. Signalling cables are designed to carry current of usually less than one ampere per conductor to operate signal circuit devices.

In railway systems, the electromagnetic fields resulting from the power supply voltage of the catenaries (typically 25 KV AC) induce current in the parallel laid signalling cables, which can spoil the equipment connected to them and present a safety hazard. In order to reduce this influence to a non-hazardous level, the cables are provided with a metallic shield. The protective effect of this shield is rated as "reduction factor" (rf). The reduction factor is the ratio of the induced tension with shielding to the induced tension without shielding. The reduction factor is dependent on the materials used for shielding, the conducting cross-section of the shielding as well as the frequency of the interfering signal.

A crucial aspect of signalling cables is their performance in case of fire. Particularly, in case of fire, signalling cables should be fire resistant, flame retardant, have low toxicity and low smoke density properties.

For example, the Applicant developed a signalling cable, referred to as CCTSST-FR0.3 and described in the brochure "Railway Infrastructure Cables", Prysmian Group, September 2016, page 48 and in the specific product brochure "CCTSST-FR0.3", Prysmian Group, (2010). The signalling cable CCTSST-FR0.3 comprises a plurality of solid copper conductors, each being insulated by PE (polyethylene). The cable core is wrapped by two or more layers of plastic tape sequentially surrounded by a copper tape screen, a LSZH (=Low smoke zero halogen, as will be described in more detail below) inner sheath, an armour (two layers of steel tape) and a LSZH outer sheath. The cable has a reduction factor 0.3 at 50 Hz and 110-320 V/km. This cable is said to be flame retardant.

A flame retardant cable is capable of delaying the flame propagation (according, for example, to the international standard IEC 60332-3-22, 2009-02). However, the conductors are not protected against flames and, thus, operation of lines are not ensured.

The railway signalling cables should be fire resistant, too. Fire resistant cables are structured such that, in the event of fire, conductors are kept protected so that they can continue to operate for a certain time, according to, for example, the international standard IEC 60331-21 (1999) requiring the circuit integrity under fire. In particular, the interlocking systems require electrical parameters, such as resistance, capacitance and attenuation, to be kept stable.

"Caledonian Railway Cables" (www.caledonian-cables-.co.uk/DdFls/Railway%20Cables.pdf) page 107, Dec. 30, 2013 shows a signalling cable (referred to as MD4 Fire Resisting Telecom Cable) which is flame retardant according to the international standards IEC 60332-1 and IEC 60332-3, guarantees insulation integrity under fire according to the international standard IEC 60331, and have anti-induction properties. The signalling cable comprises a plurality of solid copper conductors, each being insulated with a mica tape and an LSZH layer. The cable core is wrapped by plastic tapes sequentially surrounded by a LSZH inner sheath, a copper tape screen, a LSZH intermediate sheath, an armour (two layers of steel tape) and a LSZH outer sheath.

BRIEF SUMMARY

The Applicant has observed that, to the aim of imparting a signalling cable with flame retardancy and fire resistance, a plurality of protecting layers need to be provided around the cable core. The presence of one or more of such protecting layers in radial internal position with respect to the metal screen (according, for example, to the structure of Caledonian's MD4 cable) can make the metal sheath diameter greater and improve (i.e. decrease) the reduction factor. On the other side, this makes the cable bigger, heavier, and more expensive and complex to be manufactured.

The specification provides a flame retardant and fire resistant signalling cable, particularly for railway applications, which maintains a low reduction factor and at the same time a sufficiently simple and light structure.

A signalling cable comprising:

- a cable core comprising:
  - a plurality of electric conductors each insulated by a fire barrier and a flame retardant low smoke zero halogen polymeric insulating layer;
- a core wrap;
- a metallic screen surrounding and in direct contact with the cable core;
- at least one flame retardant low smoke zero halogen polymeric sheath in radially outer position with respect to the metallic screen.

The Applicant has found that a signalling cable with a cable core comprising conductors insulated by mica and a low smoke zero halogen (LSZH) polymer layer, a copper screen in direct contact with the core and two LSZH polymer layers in outer position with respect to the copper screen is fire resistant according to the international standard IEC 60331-21, is flame retardant according to the international standards IEC 60332-3-24 and IEC 60332-1-2 and has a reduction factor 0.3 at 50 Hz and 110-320 V/km.

BRIEF DESCRIPTION OF THE DRAWINGS

Further characteristics and advantages will be more apparent from the following description of some embodiments given as a way of an example with reference to the enclosed drawings in which:

FIG. 1 is a sectional view of a signalling cable according to an embodiment of the disclosure.

DETAILED DESCRIPTION

For the purpose of the present description and of the appended claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

The present disclosure, in at least one of the aforementioned aspects, can be implemented according to one or more of the following embodiments, optionally combined together.

For the purpose of the present description and of the appended claims, the words "a" or "an" should be read to include one or at least one and the singular also includes the plural unless it is obvious that it is meant otherwise. This is done merely for convenience and to give a general sense of the disclosure.

FIG. 1 shows an embodiment of a signalling cable 1 according to the present disclosure. The signalling cable 1 is adapted for railway applications, as discussed in the introductory part of the present description.

The signalling cable 1 comprises a cable core 2 where a plurality of electric conductors 3 are wounded around a central filler 4, and a core wrap 5 is helically or longitudinally provided around electric conductors 3 and central filler 4.

Each of the electric conductors 3 (which are made of an electrically conductive metal such as copper or aluminium, in form of a rod or of twisted wires) is electrically insulated by a fire barrier 3*a* and a flame retardant LSZH polymer insulating layer 3*b*.

According to an embodiment, the fire barrier 3*a* comprises at least one mica tape wrapped around each electric conductor 3. In the present description and claims, by "mica tape" is meant a tape comprising a layer of mica flakes attached to a backing layer. The mica layer is typically formed of one or more types of mica flakes (e.g., muscovite and/or phlogopite), arranged to form a mica paper or sheet. The mica layer is generally impregnated or coated with a binding agent (e.g. silicone resin or elastomer, acrylic resin, and/or epoxy resin). The backing layer is formed of a supporting fabric (e.g., woven or unwoven glass). The mica layer is generally bonded to the backing layer by the same binding agent.

In an embodiment, the mica tape 3*a* is helically wound around each conductor 3 with 50% overlapping.

According to an embodiment, the flame retardant insulating layer 3*b* comprises an LSZH polymer material, extruded on the conductor 3. In an embodiment, the LSZH polymer material of the flame retardant insulating layer 3*b* has a limiting oxygen index (LOI) of at least 30%.

"LSZH (or LSOH) material" stands for "low smoke zero halogen material" and is also known as HFFR, i.e. halogen-free flame retardant material. Flame retardant LSZH materials do not release toxic fumes while burning.

Within the present description and the subsequent claims, the limiting oxygen index (LOI) is the minimum concentration of oxygen, expressed as percentage, which will support combustion of a polymer in case of fire. The higher the LOI value is, the greater is the flame retardancy. LOI values are determined by standardized tests, such as ASTM D2863-12 (2012)

In an embodiment, the LSZH flame retardant polymer material of the insulating layer 3*b* comprises a polymer selected from: polyethylene; copolymers of ethylene with at least one α-olefin containing from 3 to 12 carbon atoms, and optionally with at least one diene containing from 4 to 20 carbon atoms; polypropylene; thermoplastic copolymers of propylene with ethylene and/or at least one α-olefin containing from 4 to 12 carbon atoms; copolymers of ethylene with at least one ester selected from alkyl acrylates, alkyl methacrylates and vinyl carboxylates, wherein the alkyl and the carboxylic groups comprised therein are linear or branched, and wherein the linear or branched alkyl group may contain from 1 to 8, for example from 1 to 4, carbon atoms, while the linear or branched carboxylic group may contain from 2 to 8, for example from 2 to 5, carbon atoms; and mixtures thereof. With "α-olefin" it is generally meant an olefin of formula CH2═CH—R, wherein R is a linear or branched alkyl having from 1 to 10 carbon atoms. The α-olefin can be selected, for example, from propylene, 1-butene, 1-pentene, 4-methyl-1-pentene, 1-hexene, 1-octene, 1-dodecene and the like. In an embodiment, the α-olefin is selected from propylene, 1-butene, 1-hexene and 1-octene. Examples of polymer that may be used in the flame retardant LSZH polymeric material for the insulating layer 3*b* of the present disclosure are: high-density polyethylene (HDPE) (d=0.940-0.970 g/cm$^3$), medium-density polyethylene (MDPE) (d=0.926-0.940 g/cm$^3$), low-density polyethylene (LDPE) (d=0.910-0.926 g/cm$^3$); linear low-density polyethylene (LLDPE) and very-low-density polyethylene (VLDPE) (d=0.860-0.910 g/cm$^3$); polypropylene (PP); thermoplastic copolymers of propylene with ethylene; ethylene/vinyl acetate (EVA) copolymers; ethylene/ethyl acrylate (EEA) copolymers, ethylene/butyl acrylate (EBA) copolymers; ethylene/α-olefin rubbers, in particular ethylene/propylene rubbers (EPR), ethylene/propylene/diene rubbers (EPDM); and mixtures thereof.

In the embodiment of FIG. 1, the insulated electric conductors 3 are twisted in groups so to form a plurality of quads 6 (for example, five quads 6), which can be, in turn, helically stranded, for example around the central filler 4. Thus, the cable 1 of FIG. 1 comprises twenty conductors.

In another, not illustrated embodiment, the insulated conductors 3 may be provided in form of twisted pairs helically stranded, or can be individually helically stranded, for example around the central filler 4.

The number of insulated conductors possibly comprised by the cable of the present disclosure varies according to the sought application, and may range, for example, from two to two hundred.

The cable core 2 of FIG. 1 comprises a central filler 4 acting as a dummy core for the quads 6. The central filler 4 can comprise a flame retardant LSZH material, for example a material, such as an LSZH polymer, as described with reference to the insulation 3*b*.

In another, not illustrated embodiment, the central filler dummy rod can be absent.

The cable core 2 comprises a core wrap 5 holding the stranded quads 6 formed by the insulated conductors 3 of the core 2. The core wrap 5 may comprise one or more inflammable tapes, for example plastic tapes, applied longitudinally or helically over the stranded quads 6 so to form one or more overlapping layers. For example, the core wrap 5 may be made of polyester.

The signalling cable 1 comprises a metallic screen 7, for example a copper screen, surrounding the cable core 2 and in direct contact with the latter, specifically with the core wrap 5. Since the metallic screen 7 is in direct contact with the core wrap 5, no intermediate layers are provided between them. According to an embodiment, the metallic screen 7 comprises a copper tape, corrugated or smooth, applied, for example, longitudinally with overlap over the cable core 2. Alternatively, the copper tape can be helically wound around the cable core 2.

The metallic screen 7 provides the cable core 2 with protection against fire and has a role in obtaining the desired reduction factor against electromagnetic interferences. To the latter end, the metallic screen 7 has a predetermined thickness depending on the cable structure with a special regard to the number of insulated conductor present in the cable core. The thickness of the metal screen can be determined by the skilled person.

The signalling cable of the present disclosure comprises one or more flame retardant LSZH polymeric sheaths positioned in a radially outer position with respect to the metallic screen. It is to be noted that no flame retardant layers or sheaths are provided in a radially inner position with respect to the metallic screen because, as already mentioned, the latter is in direct contact with the cable core.

According to the embodiment of FIG. 1, the one or more flame retardant LSZH polymeric sheaths comprise an inner flame retardant LSZH polymeric sheath 8 in a radially outer position with respect to the metallic screen 7, for example in direct contact with the latter, and an outer flame retardant LSZH polymeric sheath 9 in a radially outer position with respect to the inner flame retardant LSZH polymeric sheath 8.

The outer flame retardant LSZH polymeric sheath 9 can be the outermost layer of the signalling cable 1. In an embodiment, an antirodent additive can be applied on it.

The LSZH polymer material of the inner and the outer sheaths can be as described with reference to the insulating layer 3*b*.

In the embodiment of FIG. 1, the signalling cable 1 comprises an armour 10 positioned, for example, between the inner 8 and the outer 9 flame retardant LSZH polymeric sheath, for example in direct contact with both of them. According to an embodiment, the armour 10 comprises one or more, for example two, layers of galvanized steel tape, for example helically wrapped. The armour 10 can also acts as a further fire protection and has a role in obtaining the desired reduction factor.

A cable according to the present disclosure and having the structure depicted in FIG. 1 has, for example, the dimensions set forth in Table I.

TABLE I

| Element | Material/form | Dimension |
|---|---|---|
| Conductor (5 quads) | Copper | 1.5 $mm^2$ each conductor |
| Central filler | LSZH material | 5.6 mm outer diameter |
| Fire Barrier | two mica tapes with 50% | 2 mm thick |
| Insulating layer | LSZH material | 3.3 mm thick |
| Core wrap | one tape | one polyester tape 0.05 mm thick |
| Metallic screen | corrugated copper tape longitudinally applied | 0.2 mm thick |
| Inner sheath | LSZH material | 1.5 mm thick |
| Armour (B) | Two layers of helically wrapped galvanized steel tape | 0.5 mm thick tape |
| Outer sheath | LSZH material | 1.6 mm thick |

A cable having the features and dimensions of Table I has a weight of about 1670 kg/km and an outer diameter of about 33.25 mm.

The cable illustrated in Table I was tested for ascertain the compliance of the circuit integrity fire according to IEC 60331-21 (1999), at a voltage of 300V for 180+15 minutes. The cable passed the test by showing no conductor breakdown.

In addition, the above cable also passed the following tests: vertical flame spread of vertically-mounted cables (IEC 60332-3-24, 2000); vertical flame propagation for a single insulated wire or cable (IEC 60332-1-2, 2004); IEC 60754-1 No halogens; IEC 60754-2 No acid matters; smoke density of cables burning (IEC 61034-2, 2005).

A cable with a design like that of FIG. 1 has been tested (according to DIN57472/VDE 0472, 1983) to measure their reduction factor at 50 Hz and from 100 V/km to 350 V/km. The results are set forth in Table II.

TABLE 2

| Voltage induced in the cable sheath (V) | Voltage induced in the conductor (V) | Current induced in the conductor (A) | Rf |
|---|---|---|---|
| 100 | 29 | 32 | 0.29 |
| 150 | 35.3 | 42 | 0.24 |
| 200 | 43.5 | 54 | 0.22 |
| 250 | 55.8 | 69 | 0.22 |
| 300 | 73.9 | 90 | 0.25 |
| 350 | 97.9 | 115 | 0.28 |

The invention claimed is:

1. A signalling cable comprising:

a cable core including:

a plurality of insulated electric conductors each including an electric conductor insulated by a fire barrier layer and a flame retardant low smoke zero halogen polymeric insulating layer, and an inflammable core wrap that wraps the plurality of electric conductors;

a metallic screen surrounding and in direct contact with the inflammable core wrap;

at least one flame retardant low smoke zero halogen polymeric sheath surrounding the metallic scree; and an armour layer surrounding the metallic screen.

2. The signalling cable according to claim 1, wherein the at least one flame retardant low smoke zero halogen polymeric sheath includes an inner flame retardant low smoke zero halogen polymeric sheath in a radially position with respect to the metallic screen and an outer flame retardant low smoke zero halogen polymeric sheath surrounding the inner flame retardant low smoke zero halogen polymeric sheath and in a radially position with respect to the inner flame retardant low smoke zero halogen polymeric sheath.

3. The signalling cable according to claim 1, wherein the armour layer surrounds a flame retardant low smoke zero halogen polymeric sheath of the at least one flame retardant low smoke zero halogen polymeric sheath.

4. The signalling cable according to claim 3, wherein the armour is positioned between a first flame retardant low smoke zero halogen polymeric sheath of the at least one flame retardant low smoke zero halogen polymeric sheath and a second flame retardant low smoke zero halogen polymeric sheath of the at least one flame retardant low smoke zero halogen polymeric sheath.

5. The signalling cable according to claim 1, wherein the armour layer includes one or more layer of helically wrapped galvanized steel tape.

6. The signalling cable according to claim 1, wherein the fire barrier layer includes a mica tape wrapped around the conductor.

7. The signalling cable according to claim 1, wherein the insulated electric conductors are twisted in groups forming a plurality of quads.

8. The signalling cable according to claim 7, wherein the quads are helically stranded.

9. The signalling cable according to claim 1, wherein the inflammable core wrap includes one or more plastic tapes applied longitudinally or helically over the insulated electric conductors.

10. The signalling cable according to claim 1, wherein the cable core includes a central filler.

11. The signalling cable according to claim 10, wherein the central filler includes a flame retardant low smoke zero halogen polymer.

12. The signalling cable according to claim 1, wherein the metallic screen includes a copper tape.

13. The signalling cable according to claim 12, wherein the copper tape is a corrugated copper tape and is applied longitudinally over the cable core with overlapping.

14. The signalling cable according to claim 12, wherein the copper tape is helically wound around the cable core.

15. The signalling cable according to claim 1, wherein the fire barrier layer includes a mica tape helically wound around the electrical conductor with 50% overlapping.

16. The signalling cable according to claim 1, wherein the inflammable core wrap includes one or more inflammable tapes.

* * * * *